252-99 AU 157 EX

10/23/84 OR 4,478,733 col. 6 (not effective)

United States Patent [19]

Oakes

[11] Patent Number: 4,478,733

[45] Date of Patent: Oct. 23, 1984

[54] DETERGENT COMPOSITIONS

[75] Inventor: John Oakes, South Wirral, England

[73] Assignee: Lever Brothers Company, New York, N.Y.

[21] Appl. No.: 559,593

[22] Filed: Dec. 8, 1983

[30] Foreign Application Priority Data

Dec. 17, 1982 [GB] United Kingdom ..... 8236005

[51] Int. Cl.[3] ..... C11D 3/04; D06L 3/02

[52] U.S. Cl. ..... 252/99; 252/95; 252/133

[58] Field of Search ..... 252/95, 99

[56] References Cited

U.S. PATENT DOCUMENTS

| | | | |
|---|---|---|---|
| 3,156,654 | 11/1964 | Konecny et al. | 252/186.38 |
| 3,372,125 | 3/1968 | Hill et al. | 252/99 |
| 3,398,096 | 8/1968 | Das et al. | 252/95 |
| 3,532,634 | 10/1970 | Woods | 252/186.4 |
| 4,119,557 | 10/1978 | Postlethwaite | 252/99 |
| 4,208,295 | 6/1980 | Sai et al. | 252/94 |

FOREIGN PATENT DOCUMENTS

| | | |
|---|---|---|
| 82563 | of 0000 | European Pat. Off. . |
| 25608 | of 0000 | European Pat. Off. . |
| 70079 | of 0000 | European Pat. Off. . |
| 984459 | of 0000 | United Kingdom . |

*Primary Examiner*—Maria Parrish Tungol

*Attorney, Agent, or Firm*—Milton L. Honig; James J. Farrell

[57] ABSTRACT

Alkaline built detergent bleach compositions are disclosed comprising a surface-active agent; a peroxide compound bleach; a manganese compound which delivers manganese (II) ions in aqueous solution (e.g. manganous sulphate or manganous chloride); and a builder mixture comprising a water-insoluble aluminosilicate ion-exchange material and an alkalimetal orthophosphate and/or an alkalimetal silicate. The composition is particularly effective for washing fabrics at lower temperatures, e.g. from 20° to 60° C., but is also usable at higher temperatures.

6 Claims, No Drawings

Ly Preparation

II

DETERGENT COMPOSITIONS

This invention relates to detergent compositions comprising a peroxide compound bleach suitable for the bleaching and cleaning of fabrics. The peroxide compound bleach used herein includes hydrogen peroxide and hydrogen peroxide adducts, e.g. inorganic persalts, which liberate hydrogen peroxide in aqueous solutions such as the water-soluble perborates, percarbonates, perphosphates, persilicates and the like.

Detergent compositions comprising said peroxide compounds are known in the art. Since said peroxide compounds are relatively ineffective at lower temperatures, i.e. up to 70° C. these compositions have to be used at near boiling temperatures in order to achieve a satisfactory bleach.

Various proposals have been made to activate peroxide compounds so as to make then usable bleaches at lower temperatures. One proposed route is the use of so-called organic activators—usually organic compounds having one or more reactive acyl residues—which in solution react with the peroxide compound, e.g. sodium perborate, to form an organic peroxy-acid e.g. peroxyacetic acid, which is a more effective bleach at lower temperatures. Such bleach activators are described for example in a series of articles by Allan H. Gilbert in "Detergent Age", June 1967, pages 18–20, July 1967, August 1967, pages 26, 27 and 67.

Another approach is the use of heavy metal ions of the transition series which catalyse peroxide decomposition, together with a special type of chelating agent for said heavy metal. U.S. Pat. No. 3,156,654 discloses that only by a proper choice of the heavy metal and of the chelating agent, not only with respect to each other but also in regard of the adsorption power of the material to be bleached i.e. fabrics, relative to the complexing strength of the chelating agent, an improved bleaching can be obtained. The chelating agent, according to this U.S. patent, must be one which is not a stronger complexing agent for the heavy metal ions present than the material to be bleached is. No further concrete examples of metal/chelating agent combinations are given, except for cobalt and copper salts used in conjunction with pyridine carboxylic acid chelating agents, preferpreferably as a preformed complex.

U.S. Pat. No. 3,532,634 discloses bleaching compositions comprising a persalt, an organic activator and a transition metal, together with specially selected chelating agents. The transition metals applicable according to this U.S. patent have atomic numbers of from 24 to 29.

British Pat. No. 984,459 suggested the use of a copper salt in combination with a sequestering agent which is methylaminodiacetic acid, aminotriacetic acid or hydroxyethylaminodiacetic acid.

U.S. Pat. No. 4,119,557 suggested the use of a preformed ferric ion complex with a polycarboxyamine type chelating agent.

U.S. Pat. No. 3,372,125 discloses the use of metal-cyano complexes, particularly Fe-cyano complexes, in denture cleansing compositions comprising dipotassium persulphate, sodium perborate, sodium carbonate and trisodium phosphate.

Still the main problem with heavy metal catalysts is that the results are often inconsistent and/or unsatisfactory, particularly if used for washing fabrics at lower temperatures.

It is an object of the invention to provide an improved detergent bleach composition which is effective at lower temperatures, e.g. from 20° to 60° C., without the use of organic peracids or organic activators forming peroxy acids as the bleaching species.

European Patent Application No. 82563 (published June 29, 1983) describes the use of manganese/carbonate mixtures.

It has now surprisingly been found that manganese has outstanding properties with respect to consistently improving the bleach performance of peroxide compounds at substantially all temperatures, e.g. from 20° to 95° C., particularly at lower temperatures, e.g. from 20° to 60° C., if used in the presence of a builder system comprising a water-insoluble aluminosilicate cation-exchange material and an alkalimetal orthophosphate and/or an alkalimetal silicate.

The manganese used according to the present invention can be derived from any manganese (II) salt, such as manganous sulphate and manganous chloride, or from any other manganese compound which delivers manganese (II) ions in aqueous solution.

Accordingly the invention provides a built detergent bleach composition comprising a peroxide compound and a heavy metal compound, characterized in that it comprises a manganese compound which delivers manganese (II) ions in aqueous solution and a builder system comprising a water-insoluble aluminosilicate cation-exchange material and an alkalimetal orthophosphate and/or an alkalimetal silicate.

The optimum level of manganese (II) ions—$Mn^{2+}$—in the wash/bleach solution is dependent upon the formulation in which the manganese as bleach catalyst is applied. In terms of parts per million (ppm) of manganese (II) ions in the wash/bleach solution a suitable range will generally be from 0.1 to 50 ppm, preferably from 0.5–25 ppm.

These compound roughly to a manganese (II) metal content in a bleach or detergent composition of about 0.005–2.5% by weight, preferably from 0.025–1.0% by weight of the composition.

The level of peroxide compound bleach in the composition of the invention will normally be within the range of about 4 to about 50% by weight, preferably from 10 to 35% by weight of the total composition.

A preferred peroxide compound is alkalimetal perborate, particularly sodium perborate, which may be in its tetrahydrate or its lower hydrate form.

The alumino-silicate cation exchange material is a crystalline or amorphous material having the general formula:

$$(Cat_{2/n}O)_x.Al_2O_3.(SiO_2)_y.zH_2O$$

wherein Cat is a cation having valency n that is exchangeable with calcium (e.g. $Na^+$ or $K^+$); x is a number from 0.7–1.5; y is a number from 1.3–4; and z is such that the bound water content is from 10% to 28% by weight.

Preferably a crystalline material is used which can be described by the unit cel content:

$$Na_x[(AlO_2)_x.(SiO_2)_y]zH_2O$$

wherein x and y are integers of at least 6, the ratio of x to y being in the range of 1:1 to 1:2; and z is such that the bound water content is from 10% to 28% by weight.

The alumino-silicate preferably has a particle size of from 0.1 to 100 micrometers, ideally between 0.1 and 10 micrometers, and an ion exchange capacity of at least 200 mg $CaCO_3$ per gram of alumino-silicate (anhydrous basis).

In a preferred embodiment, the water-insoluble alumino-silicate is a crystalline material having the formula described by the unit cell content:

$$Na_{12}(AlO_2)_{12}.(SiO_2)_{12}.zH_2O$$

wherein z is from 20 to 30, preferably about 27.

An examples of this material is the commercially available product known as Zeolite type A, which is typically:

$$Na_2O.Al_2O_3.2SiO_24.5H_2O$$

and is also described by the unit cell content:

$$Na_{12}[(AlO_2)_{12}.(SiO_2)_{12}].27H_2O.$$

Such aluminosilicates are described in for example British Patent Specification Nos. 1,470,250 and 1,429,143.

Preferred alkalimetal orthophosphate is sodium orthophosphate.

Preferred alkalimetal silicate is sodium silicate of which the $Na_2O:SiO_2$ ratio may vary from 1:3.5 to 2:1, preferably from 1:2.6 to 1:1. Examples of suitable sodium silicate are sodium orthosilicate, sodium disilicate and the various alkaline sodium silicates.

The aluminosilicate cation-exchange material and the alkalimetal orthophosphate and/or the alkalimetal silicate may be used as the sole builders in the composition of the invention, or they can be used in admixture with other principal or non-principal builders known in the art in minor amounts to the main builder mixture of the invention.

Consequently the total amount of aluminosilicate and orthophosphate in the composition of the invention can be varied as desired for providing the required builder capacity of the composition with or without the presence of other builders.

Preferably the composition of the invention comprises from 10 to 50%, particularly from 15 to 45% by weight of a water-insoluble alumino-silicate cation-exchange material.

The alkalimetal orthophosphate may be present in an amount of from 3 to 50%, preferably from 5 to 25% by weight of the composition. The alkalimetal silicate may be present in an amount of from 1 to 20%, preferably from 3 to 15% by weight of the composition.

The composition of the invention is alkaline in nature and should preferably have a pH within the range of between 9.5 and 11.0.

Any manganese (II) salt can in principle be employed, such as for example manganous sulphate ($MnSO_4$), either in its anhydrous form or as hydrated salt, manganous chloride($MnCl_2$), anhydrous or hydrated, and the like.

Generally, the detergent bleach compositions of the invention will include at least one organic soap or synthetic detergent-active material. Preferably, from about 2% to 50% by weight of an organic, anionic, nonionic, amphoteric or zwitterionic detergent compound, soap or mixtures thereof are included. Many suitable detergent-active compounds are commercially available and are fully described in the literature, for example in "Surface Active Agents and Detergents", Volumes I and II, by Schwartz, Perry and Berch.

The preferred detergent-active compounds which can be used are synthetic anionic, soap and nonionic compounds. The first-mentioned are usually water-soluble alkali metal salts of organic sulphates and sulphonates having alkyl radicals containing from about 8 to about 22 carbon atoms, the term alkyl being used to include the alkyl portion of higher aryl radicals. Examples of suitable anionic detergent compounds are sodium and potassium alkyl sulphates, especially those obtained by sulphating higher ($C_8$–$C_{18}$) alcohols produced for example from tallow or coconut oil; sodium and potassium alkyl ($C_9$–$C_{20}$) benzene sulphonates, particularly sodium linear secondary alkyl ($C_{10}$–$C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_9$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulphonates such as those derived by reacting alpha-olefins ($C_8$–$C_{20}$) with sodium bisulphate and those derived by reacting paraffins with $SO_2$ and $Cl_2$ and then hydrolyzing with a base to produce a random sulphonate; olefin sulphonates, which term is used to describe the material made by reacting olefins, particularly $C_{10}$–$C_{20}$ alpha-olefins, with $SO_3$ and then neutralizing and hydrolyzing the reaction product; and alkali metal salts of long-chain $C_8$–$C_{22}$ fatty acids such as the sodium soaps of tallow, coconut oil, palmkernel oil, palm oil or hardened rapeseed oil fatty acids or mixtures thereof. The preferred anionic detergent compounds are sodium ($C_{11}$–$C_{15}$) alkyl benzene sulphonates and sodium ($C_{16}$–$C_{18}$) alkyl sulphates.

Examples of suitable nonionic detergent compounds which may be used include the reaction products of alkylene oxides, usually ethylene oxide, with alkyl ($C_6$–$C_{22}$) phenols, generally 5 to 25 EO, i.e. 5 to 25 units of ethylene oxide per molecule; the condensation products of aliphatic ($C_8$–$C_{18}$) primary or secondary linear or branched alcohols with ethylene oxide, generally 6 to 30 EO, and products may be condensation of ethylene oxide with the reaction products of propylene oxide and ethylene diamine. Other so-called nonionic detergent compounds include long-chain tertiary amine oxides, long-chain tertiary phosphine oxides and dialkyl sulphoxides.

Mixtures of detergent-active compounds, for example mixed anionic or mixed anionic and nonionic compounds, may be used in the detergent compositions, particularly in the latter case to provide controlled low sudsing properties. This is beneficial for compositions intended for use in suds-intolerant automatic washing machines.

Amounts of amphoteric or zwitterionic detergent-active compounds can also be used in the compositions of the invention, but this is not normally desired owing to their relatively high cost. If any amphoteric or zwitterionic detergent-active compounds are used, it is generally in small amounts in compositions based on the much more commonly used synthetic anion and/or nonionic detergent-active compounds.

The composition of the present invention is preferably substantially free of other inorganic phosphate builders. However, if desired, the composition may contain said other inorganic phosphate such as the alkali metal (preferably sodium) triphosphate, pyrophosphate or polymer phosphate, preferably at a level of up to about 25% by weight based on the total composition.

Apart from the components already mentioned, the composition of the invention can contain any of the conventional additives in the amounts in which such materials are normally employed in fabric-washing detergent compositions. Examples of these additives include lather boosters such as alkanolamides, particularly the monoethanolamides derived from palmkernel fatty acids and coconut fatty acids; lather depressants such as alkyl phosphates and silicones; anti-redeposition agents such as sodium carboxymethylcellulose, polyvinyl pyrrolidone and the cellulose ethers such as methyl cellulose and ethyl hydroxyethyl cellulose; stabilizers such as ethylenediamine tetra-acetic acid, ethylenediamine tetramethylene phosphonate and diethylenetriamine pentamethylene phosphonate; fabric-softening agents; inorganic salts such as sodium sulphate and—usually present in very minor amounts—fluorescent agents, perfumes, germicides and colourants.

It is desirable to include one or more antideposition agents in the cleaning composition of the invention, to decrease a tendency to form inorganic deposits on washed fabrics. The amount of any such antideposition agent is normally from about 0.1% to about 5% by weight, preferably from about 0.2% to about 2.5% by weight of the composition. The preferred antideposition agents are anionic polyelectrolytes, especially polymeric aliphatic carboxylates, or organic phosphonates.

Other non-phosphate detergency builders may be incorporated as well if desired, at a level preferably up to about 25% by weight of the composition.

The detergent bleach composition of the invention is preferably presented in free-flowing particulate e.g. powdered or granular form, and can be produced by any of the techniques commonly employed in the manufacture of such detergent compositions, but preferably by slurry-making and spray-drying processes to form a detergent base powder to which the heat-sensitive ingredients, e.g. the peroxide compound and optionally some other ingredients as desired, are added. It is preferred that the process used to form the composition should result in a product having a moisture content of not more than about 12%, more preferably from about 4% to about 10% by weight.

The manganese compound may be added to the composition as part of the aqueous slurry, which is then dried to a particle detergent powder, or preferably as a dry substance mixed in with the detergent base powder.

One major advantage of the present invention is that effective bleach improvement at substantially all temperatures is independent of specially selected chelating agents.

Furthermore the manganese (II) mixed builder system of the invention is an effective all-temperature catalyst for peroxide compounds, showing minimal wasteful solution decomposition.

EXAMPLE I

The following particulate detergent composition was prepared by spray-drying an aqueous detergent slurry forming a base powder to which there was added by dry-mixing sodium perborate. To this powder manganous sulphate was added in varying amounts.

| Composition | % by weight (A) | % by weight (B) |
|---|---|---|
| Sodium $C_{12}$-alkylbenzenesulphonate | 7.0 | 7.0 |
| Fatty alcohol - 7 ethylene oxide | 3.5 | 3.5 |
| Sodium $C_{16}$-$C_{20}$ fatty acid soap | 4.0 | 4.0 |
| Zeolite HAB A 40 (aluminosilicate ex Degussa) | 21.0 | — |
| Sodium orthophosphate | 11.6 | — |
| Sodium triphosphate | — | 25.0 |
| Sodium sulphate | 15.0 | 15.0 |
| Alkaline sodium silicate (1:2) | — | 7.0 |
| Sodium perborate tetrahydrate | 30.0 | 30.0 |

Water + minor ingredients up to 100%.

The compositions (A) were tested at a dosage of 5 g/l in a 30 minutes isothermal wash at 40° C. in 24° H water and compared with compositions (B) outside the invention.

The bleaching results obtained on tea-stained test cloths measured as ΔR (reflectance) were as follows:

TABLE I

| $Mn^{2+}$ ppm in solution | $Mn^{2+}$ % in product | ΔR (A) | ΔR (B) |
|---|---|---|---|
| 0.5 | 0.01 | 3.2 | 2.8 |
| 1.0 | 0.02 | 3.5 | 2.9 |
| 2.0 | 0.04 | 5.0 | 2.9 |
| 5.0 | 0.10 | 6.7 | 2.9 |
| 7.0 | 0.14 | 7.0 | 2.9 |
| 10.0 | 0.20 | 6.4 | 2.9 |

From the above results it is clear that manganese is substantially non-effective in the conventionally built detergent compositions (B). The manganese effect in the Zeolite/orthophosphate built detergent compositions (A) on peroxide bleaching is evident.

EXAMPLE II

The following alkaline particulate detergent compositions were prepared:

| | % by weight |
|---|---|
| Sodium $C_{12}$ alkylbenzene sulphonate | 15 |
| Aluminosilicate (Zeolite HAB A 40 ex Degussa | 25 |
| Alkaline sodium silicate | 4 |
| Sodium perborate tetrahydrate | 25 |
| Sodium sulphate | 23 |
| Water + alkaline agent | 8 |

To this powder manganous sulphate was added in varying amounts and the compositions were tested at a dosage of 5 g/l in a 30 minutes' isothermal wash at 40° C. in 24° H water.

The bleaching results obtained on tea-stained test cloths, measured as ΔR (reflectance) were as follows:

TABLE 2

| $Mn^{2+}$ % in product | $Mn^{2+}$ ppm in solution | ΔR |
|---|---|---|
| 0 | 0 | 3.55 |
| 0.01 | 0.5 | 5.28 |
| 0.014 | 0.7 | 10.21 |
| 0.017 | 0.85 | 11.22 |
| 0.02 | 1.0 | 10.30 |

TABLE 2-continued

| % in product | $Mn^{2+}$ ppm in solution | ΔR |
|---|---|---|
| 0.04 | 2.0 | 6.80 |

I claim:

1. A build detergent bleach composition comprising from 2 to 50% by weight of a surface-active agent selected from the group consisting of organic anionic, nonionic, amphoteric and zwitterionic detergents and mixtures thereof; 4–50% by weight of a peroxide compound bleach; 10–50% by weight of a water-insoluble aluminosilicate cation-exchange material; 3–50% by weight of an alkali-metal orthophosphate; 0–20% by weight of an alkalimetal silicate; and a manganese compound which delivers manganese(II) ions in aqueous solution, in an amount of from 0.005 to 2.5% by weight as manganese (II) metal based on the total detergent composition.

2. A built detergent bleach composition comprising from 2 to 50% by weight of a surface-active agent selected from the group consisting of organic anionic, nonionic, amphoteric and zwitterionic detergents and mixtures thereof; 4–50% by weight of a peroxide compound bleach; 10–50% by weight of a water-insoluble aluminosilicate cation-exchange material; 0–50% by weight of an alkali-metal orthophosphate; 1–20% by weight of an alkalimetal silicate; and a manganese compound which delivers manganese(II) ions in aqueous solution, in an amount of from 0.005 to 2.5% by weight as manganese (II) metal based on the total detergent composition.

3. A composition according to claim 1, wherein said manganese compound is a manganese (II) salt selected from manganous sulphate and manganous chloride.

4. A composition according to claim 2, wherein said manganese compound is a manganese (II) salt selected from manganous sulphate and manganous chloride.

5. A composition according to claim 1, which contains from 0.025 to 1.0% by weight of manganese (II) metal.

6. A composition according to claim 2, which contains from 0.025 to 1.0% by weight of manganese (II) metal.

* * * * *